US008322436B2

(12) United States Patent
Maa

(10) Patent No.: US 8,322,436 B2
(45) Date of Patent: Dec. 4, 2012

(54) SPLIT ASSEMBLY ATTACHMENT DEVICE

(75) Inventor: Tsorng-Jong Maa, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 635 days.

(21) Appl. No.: 12/494,037

(22) Filed: Jun. 29, 2009

(65) Prior Publication Data

US 2010/0326666 A1 Dec. 30, 2010

(51) Int. Cl.
*E21B 19/10* (2006.01)
*E21B 17/01* (2006.01)

(52) U.S. Cl. ..... 166/359; 166/338; 166/343; 166/360; 166/380; 166/77.51; 405/170

(58) Field of Classification Search ..... 166/359, 166/338–341, 343, 348, 351, 352, 360, 367, 166/378–380, 77.51, 77.53, 85.1; 405/158, 405/169, 170; 175/423
See application file for complete search history.

(56) References Cited

U.S. PATENT DOCUMENTS 2,591,763 A * 4/1952 Abegg ..... 24/114.5
2,721,581 A * 10/1955 Risley et al. ..... 138/97
3,029,095 A * 4/1962 King et al. ..... 285/411
3,414,950 A * 12/1968 Phariss ..... 24/280
3,512,229 A * 5/1970 Phariss ..... 24/280
3,675,278 A * 7/1972 Powell ..... 294/102.2
3,920,232 A * 11/1975 Clark ..... 269/25
3,934,318 A * 1/1976 Mertens ..... 269/87.2
4,120,520 A * 10/1978 Ahlstone ..... 285/18
4,168,853 A * 9/1979 Ahlstone ..... 285/336
4,209,066 A * 6/1980 Watson ..... 166/377
4,381,584 A * 5/1983 Coyle, Sr. ..... 188/67
4,491,346 A * 1/1985 Walker ..... 285/18
6,045,296 A * 4/2000 Otten et al. ..... 405/195.1
6,227,587 B1 * 5/2001 Terral ..... 294/102.2
6,321,843 B2 * 11/2001 Baker ..... 166/344
6,330,918 B1 * 12/2001 Hosie et al. ..... 166/341
6,394,201 B1 * 5/2002 Feigel et al. ..... 175/423
6,494,273 B1 * 12/2002 Martin ..... 175/220
6,695,356 B2 * 2/2004 Nguyen et al. ..... 285/321
6,892,835 B2 * 5/2005 Shahin et al. ..... 175/423
6,905,148 B2 * 6/2005 Nguyen et al. ..... 285/321
7,044,216 B2 * 5/2006 Otten et al. ..... 166/77.52
7,055,609 B2 * 6/2006 Hayes et al. ..... 166/380
7,331,395 B2 * 2/2008 Fraser et al. ..... 166/345
7,337,848 B2 * 3/2008 Fraser et al. ..... 166/345
7,360,603 B2 * 4/2008 Springett et al. ..... 166/380
7,370,707 B2 * 5/2008 McDaniel et al. ..... 166/380
7,614,453 B2 * 11/2009 Spiering et al. ..... 166/338
7,686,087 B2 * 3/2010 Pallini et al. ..... 166/367
7,963,336 B2 * 6/2011 Fraser et al. ..... 166/345
7,975,768 B2 * 7/2011 Fraser et al. ..... 166/345
8,020,626 B2 * 9/2011 Francis et al. ..... 166/380
2007/0125541 A1 * 6/2007 Bull et al. ..... 166/305.1
2007/0267197 A1 * 11/2007 Pallini et al. ..... 166/367
2011/0158748 A1 * 6/2011 Brocklebank et al. ..... 405/158

* cited by examiner

*Primary Examiner* — Matthew Buck
(74) *Attorney, Agent, or Firm* — Bracewell & Giuliani LLP

(57) ABSTRACT

A spider assembly is a round platform with a central bore used to support sections of casing as the sections of casing are joined to one another and lowered below a drilling platform. The spider assembly comprises two c-shaped section joined together at two seams, one seam at the end of each leg of the c-shape. A clamping plate is used to join each seam and apply a preload force on the joint. The preload force minimizes axial deflection at the joint.

20 Claims, 4 Drawing Sheets

SPLIT ASSEMBLY ATTACHMENT DEVICE

BACKGROUND OF THE INVENTION

1. Field of the Invention

The present invention relates in general to a method and apparatus to support wellbore tubulars above a wellbore, and in particular to a sectional "spider" riser support table that may be assembled with clamping blocks that create a preload force between sections.

2. Brief Description of Related Art

A spider assembly is a support structure placed on a drilling platform for supporting casing as sections of casing are made up and lowered below the platform. A string of riser pipe, for example, may be supported by a spider assembly as additional sections of riser pipe are added to the string and lowered from the drilling rig table to the subsea wellhead. A riser is a type of casing that runs from an offshore drilling platform down to a subsea wellhead housing.

Spider assemblies have a cylindrical shape and may have a relatively large outer diameter. For example, some spider assemblies have an outer diameter of 196". Casing is lowered through a bore in the center of the spider assembly as subsequent sections of casing are assembled, or "made up," to the casing string. Support fixtures, such as casing support dogs, are mounted to the spider assembly to hold sections of casing in a vertical position during the running process.

It may be necessary to disassemble the spider into two or more sections for transportation or for emergency reasons. The 196" diameter spider, for example, may too large to transport by some trucks on certain roads. An emergency condition may occur if a riser section is protruding through the bore of the spider assembly and the drilling rig must be moved to avoid a storm. It may be quicker to separate the spider and leave the riser in place rather than try to run the riser down or raise it up enough to disassemble it.

The joints that allow for assembly and disassembly of the spider may allow the spider to flex when a load, such as a heavy string of riser pipe, is suspended from the spider. Typical sectional spiders may have joints comprising a pin and finger-joints. These spiders have an axial deflection that could be greater than ½". The deflection may be too great for some other tools located on the spider. Hydraulic actuators on the spider, for example, may need to line up precisely with the riser pipe or with other hydraulic actuators to make the joint between each subsequent section of casing. Thus deflection in the spider assembly may prevent the actuator from functioning properly.

SUMMARY OF THE INVENTION

An assembled spider support assembly comprises two circular plates, each plate having a bore. The circular plates are axially aligned, one above the other. Spacers between the plates create an axial gap. The spacers may be housings for hydraulic "dogs" used to support the riser pipe as it is suspended from the bore of the support assembly. The assembled circular plates may be separated into two semi-circular, c-shaped halves, such that each half has half of an upper and a lower plate. The upper half-plate remains attached to the lower half-plate by way of the support dog housings.

The c-shaped halves of the circular plates may be attached to each other by a clamping block. Each clamping block has an upper and a lower lip that fits into corresponding grooves near the end of each upper and lower c-shaped half plate. The face of each clamping block is slightly recessed from the end of the leg of the c-shaped half. The distance from the end of the c-shape leg to the face of the clamping block may be 0.015" to 0.030". The ends of a c-shaped half are placed in contact with the ends of the other c-shaped half to form on o-shaped circular plate. The gap between the faces of the clamping plates is 0.030" to 0.060", because each block is recessed from the end of the c-shaped leg. Bolts are placed through holes in each block and tightened until the block faces are drawn together. As the clamping blocks are drawn together, the ends of the plates forming each c-shape are compressed towards the ends of the adjacent plates, thereby creating a preload force between the two sections. The preload force on the two halves permits the overall assembly to perform more like a continuous ring. The preload provides a significant amount of stiffness in the assembly and reduces the axial deflection associated with axial forces acting on the spider assembly, such as the force created by suspending riser pipe from the assembly.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
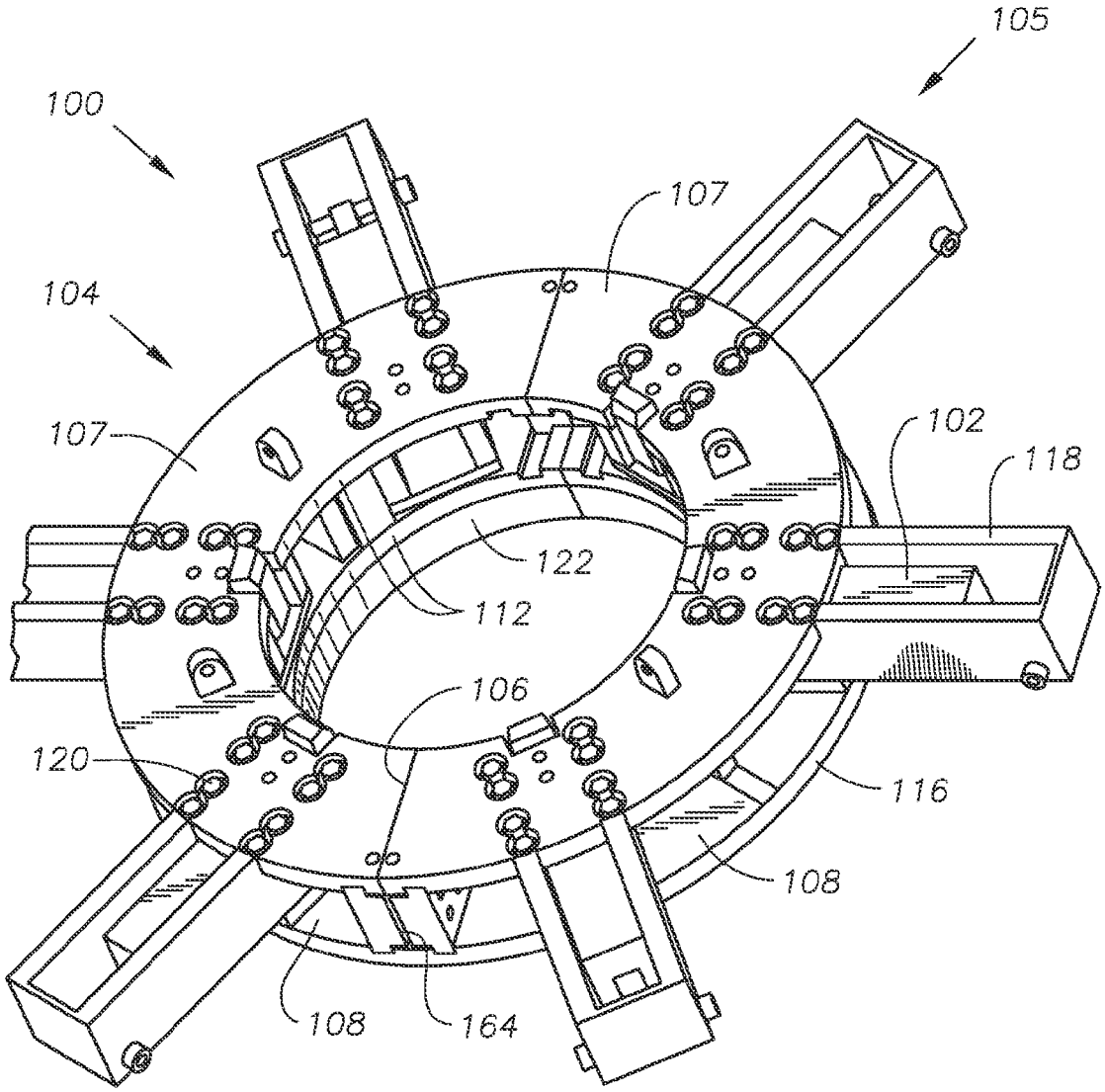
FIG. 1 is an orthogonal view of an exemplary embodiment of the preload sectional spider assembly.

Referring to FIG. 1, spider support assembly 100 is an assembly used to make up, or join, sections of riser pipe (not shown). Spider 100 is suspended over an opening on a drilling rig table (not shown) and dogs 102 located on spider 100 are used to support the weight of a first riser section (not shown) as a second riser section is stabbed into the first. A string of riser sections may be suspended below the first riser section. In an exemplary embodiment, spider 100 is 196" in diameter and weighs 45,000 pounds. Spider may be larger or smaller and may weigh more or less.

Referring to FIG. 1, spider support assembly 100 comprises a first half ring 104 and a second half ring 105. The half rings 104, 105, are joined together at seam 106. Each half ring 104, 105 comprises an upper plate 107 and a lower plate 108. Each plate 107, 108 is generally a flat plate having an inner diameter surface 112. When the half rings 104, 105 are joined together, the inner diameter surface 112 defines a bore through the center of the plates. The round bore may be axially aligned with a wellbore (not shown). The outermost edge 116 of plates 107, 108 may have a generally round shape, or may have other shapes. Upper plate 107 and lower plate 108, each rotated about the same axis, are stacked on top of each other to form each half ring 104, 105 of support assembly 100.

Frame members, such as the support housings 118 of riser support dogs 102, may be located between upper plate 107 and lower plate 108 to create a gap 110 (best seen in FIG. 4) between upper plate 107 and lower plate 108. In an exemplary embodiment, six support housings 118, each used to support dog 102 and dog actuation mechanism, are located between upper plate 107 and lower plate 108. Bolts 120 may pass through upper plate 107, through support housing 118, and through lower plate 108. Nuts (not shown) are then tightened onto bolts. In an alternative embodiment, threads are tapped into support housing 118 and bolts 120 pass through upper plate 107 or lower plate 108 and are then tightened into support housing 118. Some embodiments of the support assembly 100 may have more than two plates 107, 108.

A bolt-on gimbal support ring 122 may be attached to the lower plate 108 for interfacing with the drilling rig platform (not shown). Various assemblies may be attached between the plates 107, 108, such as dogs 102 used to support casing. Furthermore, various assemblies may be attached above the top plate 107 including, for example, hydraulic actuators for joining sections of casing, grating for operators to stand on while operating the spider, and handrails.

Figure 2:
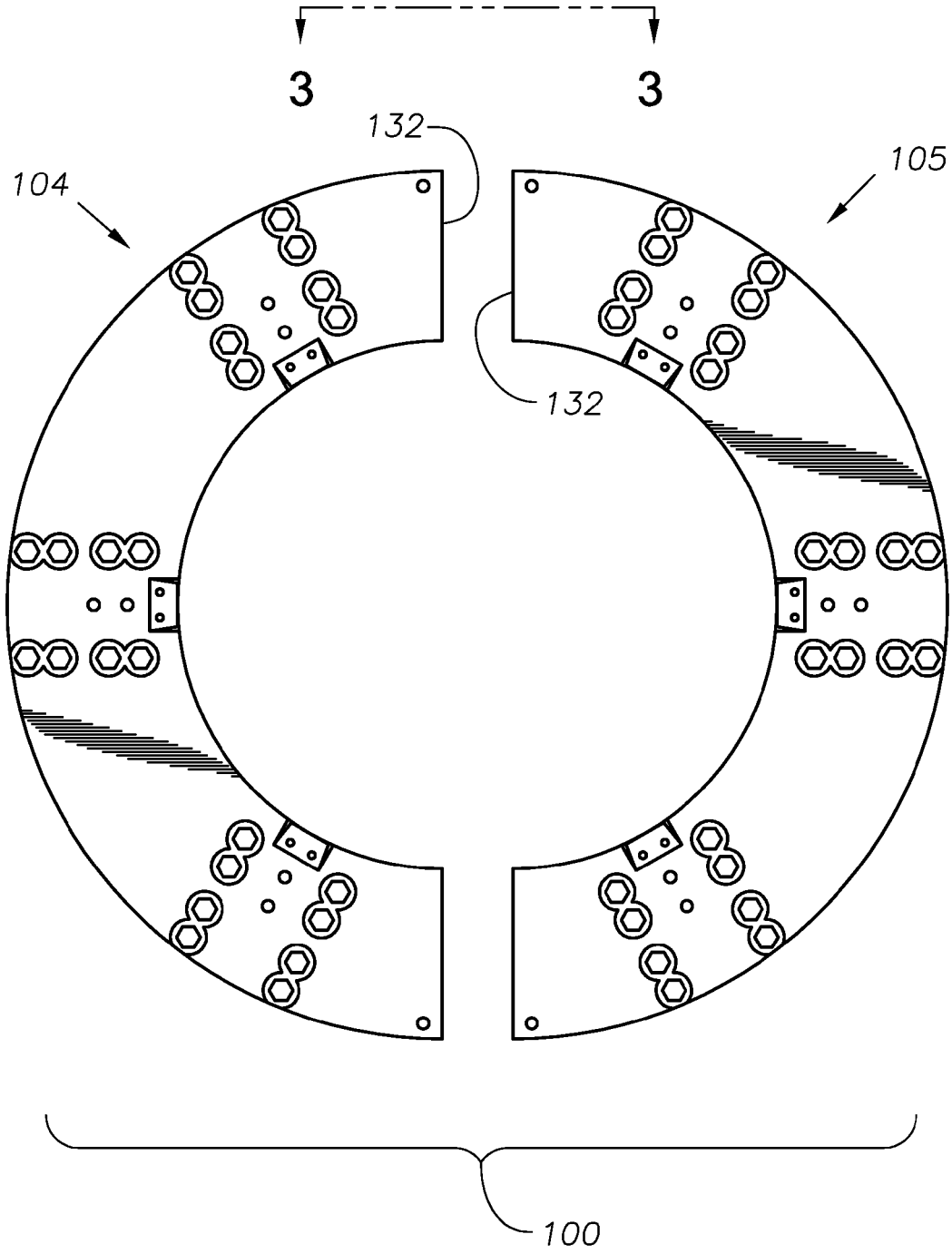
FIG. 2 is a top view of the plates of the preload spider assembly of FIG. 1.

Referring to FIG. 2, spider support assembly 100 may be split into two or more sections 104, 105 to facilitate transportation or to rapidly remove spider support assembly 100 while casing (not shown) is protruding through the bore of spider, such as under emergency conditions. Some embodiments may have plates that separate into more than two sections. Seam 106 (FIG. 1) is generally located at a point where it will not interfere with hydraulic mechanisms or dogs 102. In a preferred embodiment, each half ring 104, 105 has a c-shape. The edge surface 132 located at the end of each "c" butts against the edge surface 132 of an adjacent c-shaped half-plate to form a whole plate 104, 105 having an o-shape.

Figure 3:
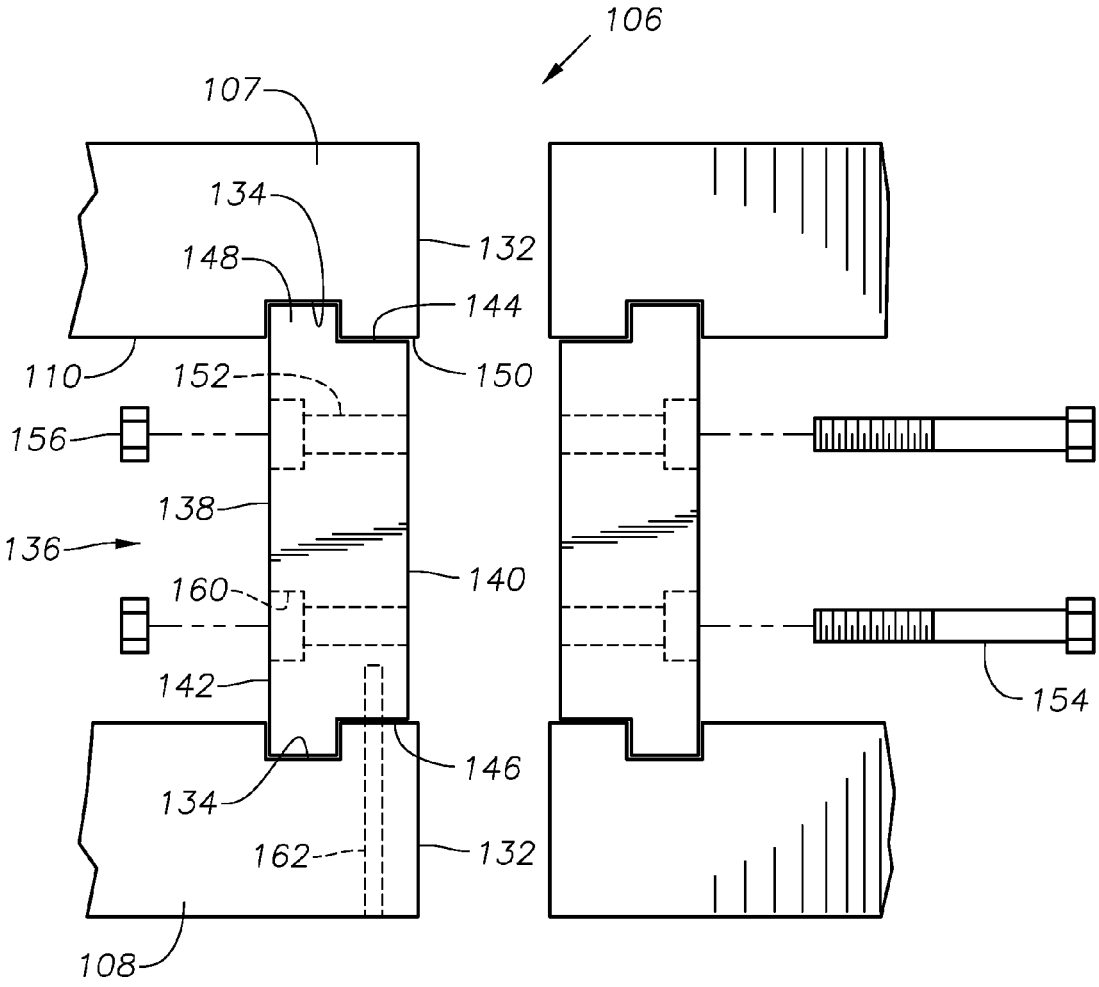
FIG. 3 is a side view of a joint of the preload spider assembly, taken along the 3-3 line.

Referring to FIG. 3, in a preferred embodiment, each seam 106 between first half ring 104 and second half ring 105 comprises an edge surface 132 and a groove 134. Groove 134 is a slot in the upper face of lower plate 108 and in the lower face of upper plate 107. Thus grooves 134 face each other for each half plate. Edge surface 132 is the end piece that will press against an edge surface of the adjoining plate 107, 108.

Referring to FIG. 3, clamping assembly 136 comprises two clamping plates 138. Each clamping plate 138 has a body having a front face 140, a back face 142, an upper surface 144, a lower surface 146, and one or more lips 148. Lip 148 is a flange protruding from upper surface 144 or lower surface 146. Lip 148 protrudes a distance roughly equal to the depth of groove 134, or may be slightly taller or slightly shorter than the depth of groove 134. The width of lip 148 may be slightly smaller or slightly larger than the width of groove 134. Thus lip 148 fits in groove 134, or in some embodiments may be force fit into groove 134.

The width of each clamping plate 138 between the inside edge of lip 148 and front face 140 is slightly smaller than the length between the inside edge of groove 134 and edge surface 132. In a preferred embodiment, the distance from the inside edge of lip 148 to front face 140 is approximately 0.015 to 0.030 inches less than the distance from the inside edge of groove 134 to edge surface 132.

In some embodiments, clamping plate 138 is attached to upper and lower plates by other means, such as by welding (not shown) or with bolts (not shown). In these embodiments, clamping plate is attached such that a gap exists between front face 140 and a plane defined by edge face of plate, and the gap is drawn together when preload stress is applied to clamps, thus causing compressive forces against edge surfaces 132. Furthermore, clamping plates (not shown) may be attached to the top surface of upper plate 107 or to the bottom surface of lower plate 108.

Clamping plate 138 has smooth cylindrical holes 152 for receiving bolts 154 for attaching clamping plate 138 to an adjacent clamping plate 138. The holes 152 pass through the clamping plate 138 from the back face 142 to the front face 140. The diameter of the smooth cylindrical holes 152 is slightly larger than the diameter of the bolts 154. Bolt holes 152 may have a counter bore 160 for receiving bolt heads so that bolt heads do not protrude from clamping plate 138 when the bolts 154 are installed.

Bolts are passed through the first clamping plate 138, from the back face 142 to the front face 140, such that the bolt threads (not shown) protrude from the front face 140 of the first clamping plate 138 and pass into the front face 140 of the second clamping plate 132. Nuts 156 may be attached to the threads of the bolts 154 to secure bolts and apply a load between the plates. In some embodiments, counterbores 160 are located on the back face 142 of the second clamping plate 132 so that nuts may be countersunk and thus not protrude from back face 142 of the second clamping plate. In some embodiments, threads are tapped into the second clamping plate 138 (not shown) and thus the bolts 154 directly engage threads of second clamping plate 138 rather than requiring nuts. In some embodiments, compression between the plates is not generated by bolts. In these embodiments, a compression device such as a c-clamp (not shown) or a cam (not shown) may be used to press clamping plates toward each other. Alternatively, a compression device such as a hydraulic actuator (not shown) may press the clamping plates and hold them in close proximity to each other while a rigid retainer (not shown) is installed to maintain the compression.

A pin 162 may pass through upper plate 107 or lower plate 108 into clamping plate 138 to prevent clamping plate 138 from falling out of position during transportation or installation. Pin 162 is generally not needed after the bolts 154 are tightened because compressive force exerted by clamping plate 138 on plates 107 and 108 prevent clamping plate 138 from falling out of position.

In an exemplary embodiment, each half ring 104, 105 of spider assembly 100 is assembled by placing support housings 118 between upper plate 107 and lower plate 108. Clamping plate 138 is installed by sliding lip 148 into grooves 134. Two pins 162 are inserted, one each through upper plate 107 and lower plate 108 into clamping plate 138. Half ring 104 has two clamping plates 138—one at each end of the c-shape.

Figure 4:
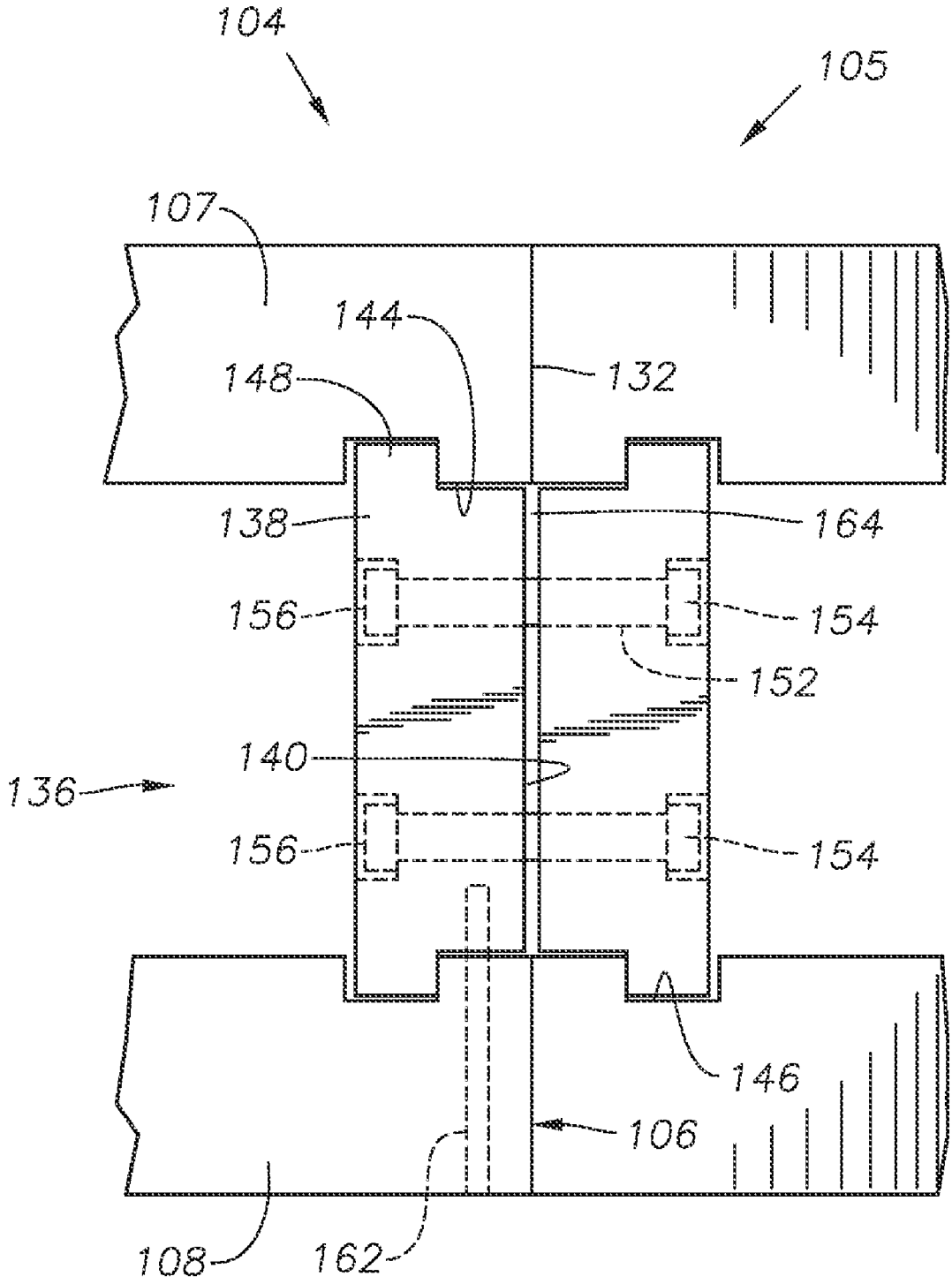
FIG. 4 is a side view of a joint of the preload spider assembly of FIG. 1, showing the gap between the clamping plates prior to apply a preload.

Referring to FIG. 4, the half rings 104, 105 of spider assembly 100 are joined by aligning end surfaces 132. When end surface 132 of first half ring 104 is in contact with end surface 132 of second half ring 105, but not under preload tension, there is a gap 164 between interior faces 140 of approximately 0.030 to 0.060 inches. Bolts 154 are passed through bolt holes 152 of clamping plates 138, and then tightened such as with nuts 156. Torque is applied to bolts 154 until the gap 164 between interior faces 140 is reduced or eliminated. Torque could be, for example, 1000 foot pounds. In some embodiments, torque is applied until interior faces 140 contact each other. Thus edge surfaces 132 are thus preloaded against adjacent edge surfaces 132. When an appropriate preload stress is applied between clamping plates 138, support assembly 100 (FIG. 1) may support a string of casing weighing 500,000 pounds and have a deflection in the axial direction, at seam 106, of less than ½". In some embodiments, deflection may 3/16" or less.

While the invention has been shown or described in only some of its forms, it should be apparent to those skilled in the art that it is not so limited, but is susceptible to various changes without departing from the scope of the invention. For example, the system could be employed by providing indication of landing of other equipment, such as a tubing hanger and tubing hanger seal.

What is claimed is:

1. A riser deploying apparatus, comprising:

a plurality of segments, each segment having a curved inner diameter portion that is a portion of a circle, each segment having two circumferentially spaced apart ends that abut adjacent ends of at least one other segment to define a circular central opening;

a retractable support member attached to the plurality of segments and movable from a retracted position inward into the central opening for supporting a first riser section while a second riser section is stabbed into the first riser section;

a preload plate attached to each end of each segment, each preload plate having a front face initially recessed from the end of the segment to which it is attached;

wherein a gap is located between the front faces of adjacent preload plates when the ends of the segments are initially abutted;

wherein forcing the adjacent preload plates toward each other reduces the gap and applies a preload force to the adjacent ends of the segments; and at least one fastener extending between the adjacent preload plates to secure the adjacent ends of the segments to each other under the preload force.

2. The apparatus according to claim 1, wherein the plurality of segments comprises two segments, and wherein the inner diameter portion of each segment extends 180 degrees.

3. The apparatus according to claim 1, wherein each segment comprises upper and lower plates and wherein the preload plates extend between the upper and lower plates.

4. The apparatus according to claim 1, wherein tightening the at least one fastener applies the preload force.

5. The apparatus according to claim 1, further comprising removable pins to hold the preload plates prior to receiving the at least one fastener.

6. The apparatus according to claim 3, wherein the plates further comprise a slot and the preload plates further comprise a lip, the lip being located in the slot.

7. The apparatus according to claim 1, wherein the central opening has an axis, and wherein the circumferentially spaced apart ends are located on radial planes from the axis.

8. The apparatus according to claim 1, wherein the central opening has an axis, and wherein the front faces of the preload plates are located on radial planes from the axis.

9. The apparatus according to claim 1, wherein each segment has an outer diameter portion, each outer diameter portion being parallel with an inner diameter portion.

10. A riser deploying apparatus, comprising:

a plurality of segments, each segment having a curved inner diameter portion that is a portion of a circle, each segment having two circumferentially spaced apart ends that abut adjacent ends of at least one other segment to define a circular central opening;

a retractable support member attached to the plurality of segments and movable from a retracted position inward into the central opening for supporting a first riser section while a second riser section is stabbed into the first riser section;

a preload plate attached to each end of each segment, each preload plate having a front face initially recessed from the end of the segment to which it is attached;

wherein a gap is located between the front faces of adjacent preload plates when the ends of the segments are initially abutted;

wherein forcing the adjacent preload plates toward each other reduces the gap and applies a preload force to the adjacent ends of the segments;

at least one fastener extending between the adjacent preload plates to secure the adjacent ends of the segments to each other under the preload force;

wherein each segment comprises upper and lower plates and wherein the preload plates extend between the upper and lower plates;

wherein the plates further comprise a slot and the preload plates further comprise a lip, the lip being located in the slot;

wherein the central opening has an axis, and wherein the circumferentially spaced apart ends are located on radial planes from the axis; and wherein the front faces of the preload plates are located on radial planes from the axis.

11. The apparatus according to claim 10, wherein the plurality of segments comprises two segments, and wherein the inner diameter portion of each segment extends 180 degrees.

12. The apparatus according to claim 10, wherein tightening the at least one fastener applies the preload force.

13. The apparatus according to claim 10, further comprising removable pins to hold the preload plates prior to receiving the at least one fastener.

14. The apparatus according to claim 10, wherein each segment has an outer diameter portion, the outer diameter portion being parallel with the inner diameter portions.

15. A method for supporting a riser, the method comprising:

(a) providing a plurality of segments, each segment having a curved inner diameter portion, two circumferentially spaced apart ends, and a preload plate attached to each end, each preload plate having a front face initially recessed from the end of the segment to which it is attached;

(b) assembling the segments so that the ends abut to define a circular central opening, resulting in a gap between the front faces of adjacent preload plates when the ends of the segments are initially abutted;

(c) forcing the adjacent preload plates toward each other, thereby reducing the gap and applying a preload force to the ends of the segments;

(d) extending fasteners between the adjacent preload plates to secure the ends of the segments to each other under the preload force; and (e) lowering a riser section through the central opening and advancing a retractable support member mounted to the segments inward into the central opening and supporting the riser section.

16. The method according to claim 15, wherein step (c) comprises tightening the fasteners.

17. The method according to claim 15, wherein step (a) comprises providing each segment with an upper plate and a lower plate.

18. The method according to claim 17, wherein step (a) comprises mounting the preload plates between the upper and lower plates.

19. The method according to claim 15, wherein step (b) results in the preload plates being in radial planes emanating from an axis of the central opening.

20. The method according to claim 15, wherein step (a) comprises providing two of the segments, the inner diameter portions of each of the segments extending 180 degrees.

* * * * *